United States Patent [19]

Holmes

[11] Patent Number: 4,566,536

[45] Date of Patent: Jan. 28, 1986

[54] METHOD FOR OPERATING AN INJECTION WELL IN AN IN-SITU COMBUSTION OIL RECOVERY USING OXYGEN

[75] Inventor: Billy G. Holmes, Lancaster, Tex.

[73] Assignee: Mobil Oil Corporation, New York, N.Y.

[21] Appl. No.: 665,869

[22] Filed: Oct. 29, 1984

Related U.S. Application Data

[63] Continuation-in-part of Ser. No. 553,925, Nov. 21, 1983, abandoned.

[51] Int. Cl.[4] ..... E21B 47/00; E21B 43/243

[52] U.S. Cl. ..... 166/251; 166/261

[58] Field of Search ..... 166/251, 256, 261, 262

[56] References Cited

U.S. PATENT DOCUMENTS

| | | | |
|---|---|---|---|
| 2,973,812 | 3/1961 | MacSporran | 166/251 |
| 3,135,324 | 6/1964 | Marx | 166/251 |
| 3,147,804 | 9/1964 | Wyllie | 166/261 |
| 3,209,825 | 10/1965 | Alexander et al. | 166/261 |
| 3,240,270 | 3/1966 | Marx | 166/251 |
| 3,349,847 | 10/1967 | Smith et al. | 166/261 |
| 3,372,754 | 3/1968 | McDonald | 166/261 |
| 4,024,915 | 5/1977 | Allen | 166/256 |
| 4,042,026 | 8/1977 | Pusch et al. | 166/251 |
| 4,136,737 | 1/1979 | Howard et al. | 166/251 |
| 4,440,227 | 4/1984 | Holmes | 166/261 |

*Primary Examiner*—Stephen J. Novosad
*Assistant Examiner*—Bruce M. Kisliuk
*Attorney, Agent, or Firm*—Alexander J. McKillop; Michael G. Gilman; Malcolm D. Keen

[57] ABSTRACT

An injection well used in an in-situ combustion oil recovery process using a high oxygen concentration gas is completed with dual tubing strings to conduct the oxygen-containing gas and nitrogen separately down the well. The gases are mixed after they leave their separate tubing strings and enter the formation through perforations in the casing. If the bottomhole temperature of the well increases to a specific level, injection of the oxygen-containing gas is terminated and injection of the nitrogen is increased to a maximum amount until the bottomhole temperature decreases to a desired level for resuming in-situ combustion. In addition, injection of water into the bottom of the well is available as a back-up in the event that injection of the nitrogen does not lower the bottomhole temperature to the desired level. The use of the separate tubing strings for nitrogen and oxygen flow permits a faster bottomhole response to be obtained if undesired temperature increases take place downhole.

13 Claims, 1 Drawing Figure

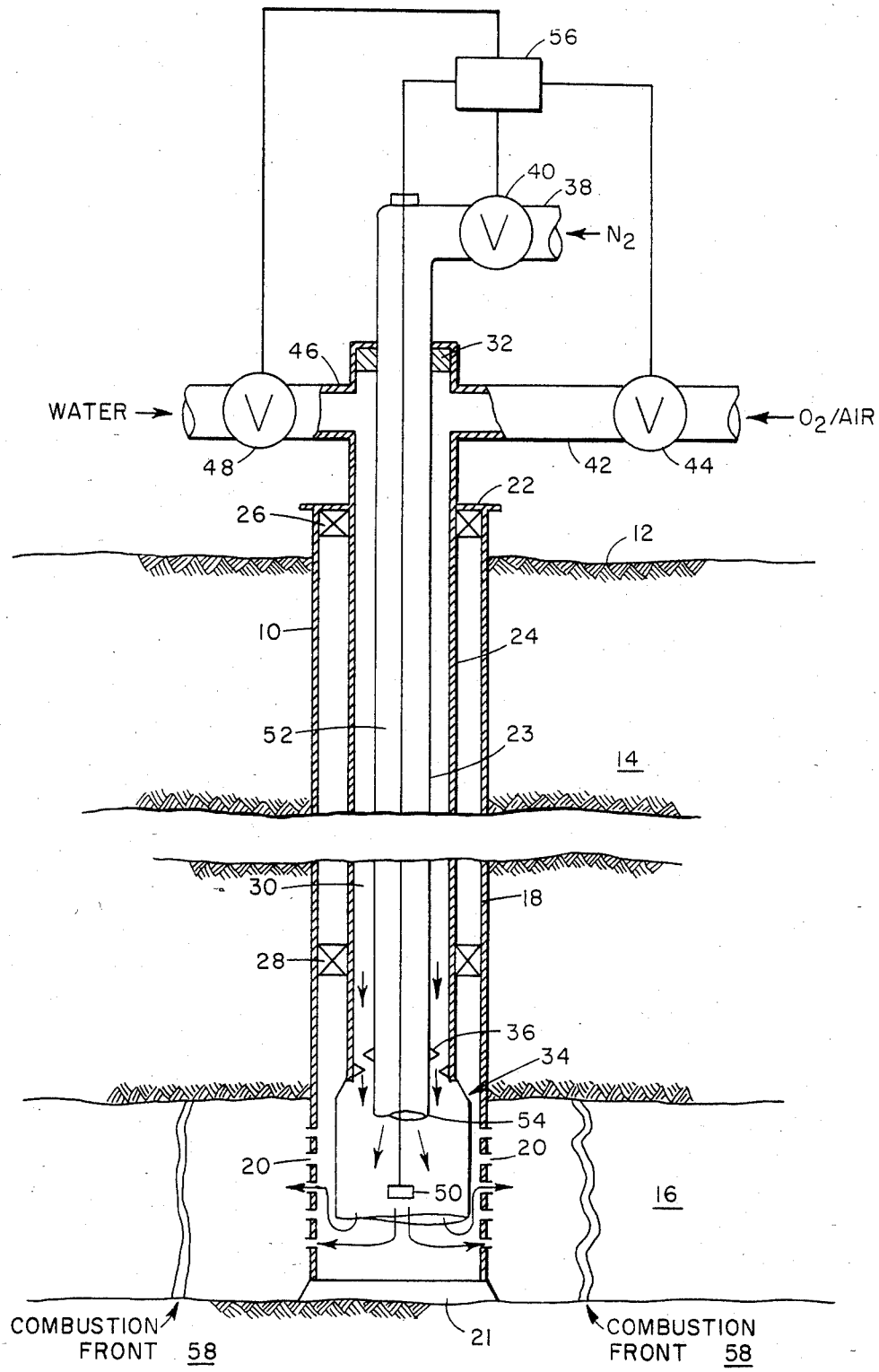
56
40
38
$N_2$
46
32
WATER
$O_2$/AIR
48
42
44
22
26
12
10
24
52
23
14
30
18
28
36
34
54
20
20
50
16
COMBUSTION FRONT 58
21
COMBUSTION FRONT 58

METHOD FOR OPERATING AN INJECTION WELL IN AN IN-SITU COMBUSTION OIL RECOVERY USING OXYGEN

CROSS REFERENCE TO RELATED APPLICATIONS

This application is a continuation-in-part of my prior application, Ser. No. 553,925, filed Nov. 21, 1983, now abandoned the entire disclosure of which is incorporated into this application by reference.

FIELD OF THE INVENTION

This invention relates to an in-situ combustion recovery process within a subterranean, oil-containing formation using high concentrations of oxygen. It relates more particularly to a method for operating an injection well in a high concentration oxygen driven in-situ combustion operation in which a small amount of nitrogen is continuously injected into the bottom of the well. The amount of nitrogen may be increased to a maximum flow rate along with a water injection back-up in order to maintain the bottomhole temperature of the injection well below a preselected level thereby quenching or preventing a wellbore fire or explosion.

BACKGROUND OF THE INVENTION

Thermal recovery techniques, in which hydrocarbons are produced from carbonaceous strata such as oil sands, tar sands, oil shales, and the like by the application of heat are becoming increasingly prevalent in the oil industry. Perhaps the most widely used thermal recovery technique involves in situ combustion or "fire flooding". In a typical fire flood, a combustion zone is established in a carbonaceous stratum and propagated within the stratum by the injection of air, oxygen enriched air or pure oxygen through a suitable injection well. As the combustion supporting gas is injected, products of combustion and other heated fluids in the stratum are forced away from the point of injection toward production zones where they are recovered from the stratum and withdrawn to the surface through suitable production wells. U.S. Pat. Nos. 3,240,270—Marx, 4,031,956—Terry, and 4,042,026—Pusch et al are examples of the recovery of oil by in-situ combustion.

In such processes, the prevention of unintended ignition due to the hazardous nature of using pure oxygen is of primary concern. For example, as the combustion zone moves away from the injection well, a large volume of unreacted oxygen sometimes accumulates near the well. If this travels upwardly in the well, a catastrophic fire possibly destroying the well, can be ignited. U.S. Pat. No. 3,125,324—Marx discusses the ignition problem. In addition, U.S. Pat. No. 4,042,026 to Pusch et al disclosed above also discusses the hazardous nature of using pure oxygen in in-situ combustion operations that could lead to uncontrolled reactions or explosions.

U.S. Pat. No. 3,240,270 to Marx discloses an in-situ combustion process for the recovery of oil in which an inert cooling fluid such as water, nitrogen, or carbon dioxide is injected into the production boreholes so as to maintain the temperature below the combustion supporting temperature at the oxygen concentration in the hole and so to prevent borehole fires.

U.S. Pat. No. 3,135,324 to Marx discloses an in-situ combustion process for recovery of oil wherein a fine dispersion of water is injected with the combustion supporting gas in a sufficient amount to maintain the temperature of the stratum around the injection well below ignition temperature.

It is an object of the present invention to provide a method and well completion for safely operating an injection well in an in-situ combustion oil recovery operation using high concentrations of oxygen.

SUMMARY OF THE INVENTION

According to the present invention, there is provided a method and a well completion for operating an injection well to control hazardous conditions in an oxygen driven in-situ combustion operation which is used for the recovery of oil from a subterranean, oil-containing formation penetrated by at least one injection well and at least one spaced-apart production well. The injection well is completed with casing which extends the length of the well, through a substantial portion of the vertical thickness of the formation, and has dual concentric tubing strings disposed within it, comprising an inner tubing and a larger diameter outer tubing. The inner tubing forms a first flow path and the inner tubing cooperating with the outer tubing to form a second flow path. The casing has passages throughout a substantial portion of the vertical thickness of the oil-containing formation to allow fluids to flow from the casing to the oil-containing formation and said first and second flow paths being in fluid communication with the portion of the casing having passages.

In operation, an in-situ combustion front is initiated in the formation by injecting air or a mixture of air and steam into the formation via one of the two flow paths and through the passages of the casing. Injection of the air into the formation is continued until the combustion front has been moved a predetermined distance into the formation. Injection of air is then terminated and oxygen enriched air or essentially pure oxygen is injected into formation via the flow path and the passages of said casing. Simultaneously, nitrogen is injected at a predetermined injection rate into the formation via the other flow path and the passages of the casing. The injected nitrogen combines with the oxygen enriched air or essentially pure oxygen in the portion of the casing containing passages and flows out into the formation through the passages of the casing. The preferred injection rate of the nitrogen during this stage of the process is within the range of 1 to 5 percent of the injection rate of the oxygen enriched air or oxygen. The bottomhole temperature of the injection well is continuously measured by a temperature sensing device, e.g. a thermocouple within the casing means in the vicinity of the oil-containing formation and located below the first flow path. If the bottomhole temperature rises to a specific temperature, the injection of the oxygen enriched air or essentially pure oxygen is terminated and the flow rate of nitrogen is increased to a maximum; injection of nitrogen is then continued at the maximum rate until the bottomhole temperature is lowered to a specific temperature. If the injection of nitrogen does not lower the bottomhole temperature to the desired level, water is injected into the formation via the other flow path (previously used for the oxygen or the air) and the passages of the casing until the temperature drops to the desired level. Once the bottomhole temperature is lowered to the desired level, the in-situ combustion operation may be resumed. If oxygen enriched air is used to continue the in-situ combustion operation after initiation, the oxygen concentration is increased in stages until essentially pure oxygen is injected.

THE DRAWING

The drawing shows a completion for an oxygen injection well in accordance with the present invention.

DETAILED DESCRIPTION

The drawing shows an injection well 10 extending from the surface 12 of the earth through the overburden 14 and into an oil-containing formation 16 from which oil is to be recovered by an in-situ combustion process. Injection well 10 is provided with a casing 18 that extends downwardly through the oil-containing formation and is in fluid communication with a substantial portion of the vertical thickness of the formation 16 by means of perforations 20. The bottom of casing 18 is sealed by means of casing shoe 21 and wellhead 22 encloses the top of casing 18.

Dual concentric tubing strings 23 and 24 are disposed inside casing 18. An upper packing gland 26 and a lower packer 28 located above the uppermost of perforations 20 seat the tubing string 24 in the well. The inner tubing 23 is disposed within the surrounding larger diameter outer tubing 24. Inner tubing 23 cooperates with the outer tubing 24 to form an annular space 30. A packing gland 32 seats inner tubing string 23 at its top. The lower end of inner tubing 23 extends to the perforations 20 of the casing 18. The lower end of outer tubing 24 extends to near the lower end of inner tubing 23. A centralizer 36 is installed in the annular space 30 near the bottom of tubing string 23 to centralize the inner tubing within the outer tubing 24. This centralizer is not continuous and therefore does not block fluid flow in annular space 30. An ignition burner 34 may be located in the casing 18 adjacent the perforations 20 below the lower ends of the inner tubing 23 and outer tubing 24.

Inner tubing string 23 passes through wellhead 22 and is connected to a source of nitrogen through conduit 38 and remote motor valve 40.

Outer tubing string 24 passes through wellhead 22 and is provided with an outlet conduit 42 connected to a source of oxygen or air through remote motor valve 44 and outlet conduit 46 connected to a source of water through remote motor valve 48.

A temperature sensing element 50 such as a thermocouple is suspended on a cable 52 disposed within inner tubing string 23. The thermocouple 50 is positioned to extend for a suitable distance beyond the lower end 54 of the inner tubing string 23 and at a location in the flow path of the fluids passing into the producing formation 16 through the casing 18 containing perforations 20. Thermocouple 50 sends signals via a suitable communication channel such as cable 52 to a suitable controller 56 in response to certain temperature conditions within the bottom of the well. Controller 56 regulates motor valves 40, 44 and 48 in order to control the amount of nitrogen, oxygen, and water injected into tubing string 23 and annular space 30 depending upon the bottomhole temperature sensed by thermocouple 50. Suspending the temperature sensing element 50 on cable 52 disposed within inner tubing 23 enables the sensing element to be easily replaced if it becomes inoperative.

The operation of the system is as follows. An in situ combustion operation is initiated in the oil-containing formation 16 which is traversed by at least one injection well 10 and at least one spaced apart production well (not shown). A combustion front 58 is established in the formation 16 by injecting air into the formation via conduit 42, annular space 30 and perforations 20 and using downhole burner 34 to obtain ignition indicated by an increase in the bottomhole temperature sensed by thermocouple 50. In another embodiment, a mixture of air and steam may be injected into the formation via conduit 42, annular space 30, and perforations 20 which will spontaneously ignite to form an in-situ combustion front without the use of ignition burner 34. In-situ combustion is initiated with air or a mixture of air and steam to eliminate the hazardous nature of using pure oxygen or oxygen-enriched air.

Once in-situ combustion has been established and the combustion front 58 has moved a predetermined distance, preferably 10 to 100 feet, into the formation, oxygen enriched air or essentially pure oxygen is introduced into the formation 16 via conduit 42, annular space 30 and perforations 20 and oil is produced from the production well. If oxygen enriched air is injected, the oxygen concentration is increased in stages until essentially pure oxygen is being injected. The oxygen injection rate and amount of oxygen injected into the formation will very depending upon the reservoir characteristic such as depth, thickness, permeability, and oil saturation.

Simultaneously with the injection of an oxygen enriched air or essentially pure oxygen into the formation to continue the in-situ combustion operation, nitrogen is injected at a predetermined injection rate is injected into inner tubing 23 via conduit 38 and motor valve 40, into the perforated portion of casing 18 where it combines with oxygen enriched air or oxygen from annular space 30 and the combined gases then pass into the formation through perforations 20. The preferred nitrogen injection rate is within the range of 1 to 5 percent of the injection rate of oxygen enriched air or oxygen. The in-situ combustion operation is continued with injection of oxygen enriched air or essentially pure oxygen along with simultaneous injection of nitrogen until the combustion front reaches the production well.

If there is a substantial increase in the bottomhole temperature sensed by thermocouple 50 during the in-situ combustion operation, indicating a potential hazardous condition such as a wellbore fire or a near fire, controller 56 terminates the flow of oxygen or oxygen enriched air by closing valve 44 and simultaneously opens motor valve 40 to increase the nitrogen flow to a maximum rate consistent with the pressure limitations of the formation. Nitrogen injection into the well and into the formation 16 through the perforations 20 at the maximum rate is continued until the bottomhole temperature is lowered to a safe level indicating that any wellbore fire or potential fire has been quenched. If the injection of nitrogen fails to bring the bottomhole temperature to the desired level, controller 56 opens motor valve 40 to allow water to be injected into well casing 18 via annular space 30 and into the formation 16 through perforations 20. Injection of water is continued until the bottomhole temperature is reduced to a safe level. Once the bottomhole temperature of the injection well is reduced to a safe level, the in-situ combustion operation is resumed as previously described. Continuous injection of nitrogen into the perforated casing 18 of the injection well 10 via tubing 23 and the optional injection of water via annular space 30 ensures adequate fire control over the injection well 10.

Because the annular space 30 between the two tubing strings 23, 24 will often have a relatively larger cross-sectional area than that of inner tubing string 23, it is preferred to conduct the oxygen (or oxygen enriched air) down this flow path rather than down the inner tubing string since the relatively larger area will decrease the linear flow velocity of the gas at equivalent mass flow rates and there are definite hazards associated with high velocity flow of oxygen or oxygen-rich gases. However, it would be possible, as an alternative to conduct the oxygen down the inner tubing string and the nitrogen down the annulus, particularly if the relative cross-sectional areas of the inner string and the annulus are adjusted in order to obtain the optimum linear gas velocities at the flow rates which are likely to be encountered. Also, it would be possible to conduct the oxygen (or oxygen-enriched air) and nitrogen down separate, non-concentric tubing strings in the casing.

The particular advantage of the separate flow passages for the oxygen (or oxygen-enriched air) and the nitrogen is that a faster response to downhole temperature excursions may be obtained, as compared to mixing of the gases at the surface with a common flowpath at the bottom of the well. If the gases are mixed at the surface, a considerable period of time will elapse before any change in gas composition takes place at the bottom of the hole since the well may be quite deep and the gas mixture will be flowing at a finite and limited velocity. Thus, if a downhole temperature excursion occurs, is detected and the gas composition changed at the surface it may be that a fire will have initiated itself and spread before a gas with a lower oxygen content can reach the bottom. By contrast, the use of separate flowpaths for the oxygen (or oxygen-enriched air) and nitrogen enables a more rapid downhole response to be achieved. Once an indication is received at the surface of an unwanted temperature excursion, the oxygen flow can be cut off immediately and nitrogen flow brought to the maximum rate. This produces a much quicker change in gas mixture downhole, with improved control over operation and with improved safety.

I claim:

1. A method for operating an injection well to control hazardous conditions in an in-situ combustion operation utilizing high concentrations of oxygen for the recovery of oil from a subterranean, oil-containing formation penetrated by at least one injection well and at least one spaced-apart production well comprising the steps of:

(a) completing the injection well with a casing means containing passages throughout a substantial portion of the vertical thickness of the oil-containing formation to allow fluids to flow from the casing means to the oil-containing formation, and dual concentric tubing strings disposed within said casing means comprising an inner tubing and a larger diameter outer tubing the lower ends of which are in fluid communication with the portion of the casing containing passages, said inner tubing forming a first flow path and the inner tubing cooperating with the outer tubing to form a second flow path;

(b) initiating an in-situ combustion front into the formation by injecting air into the portion of the casing containing the passages through one of the flow paths and from there through the passages into the formation;

(c) continuing injection of said air into the formation until the combustion front has been moved a predetermined distance into the formation;

(d) terminating injection of air and injecting oxygen enriched air into the portion of the casing containing the passages through one of the flow paths and from there through the passages into the formation;

(e) simultaneously injecting nitrogen at a predetermined injection rate into the portion of the casing containing passages via the other flow path where it combines with the oxygen enriched air and then flows into the formation through the passages of said casing means;

(f) continuously measuring the bottomhole temperature of the injection well within the casing means in the vicinity of the oil-containing formation and located below the first flow path;

(g) increasing the oxygen concentration of the oxygen enriched air to essentially pure oxygen;

(h) terminating the injection of the oxygen enriched air or essentially pure oxygen through its respective flow path when the bottomhole temperature rises to an upper specific temperature and simultaneously increasing the flow rate of nitrogen through its respective flow path into the formation to a maximum rate; and (i) continuing injection of nitrogen through its respective flow path at a maximum rate until the bottomhole temperature is lowered to a lower specific temperature.

2. The method of claim 1 further including injecting water into the formation through the flow path through which the oxygen or oxygen containing gas flowed if the injection of nitrogen during step (i) fails to lower the bottomhole temperature to the desired level.

3. The method of claim 1 wherein the injection rate of nitrogen during step (e) is within the range of 1 to 5 percent of the injection rate of the oxygen enriched air or oxygen.

4. The method of claim 1 wherein in-situ combustion during step (c) is continued until the combustion front has moved a distance of 10 to 100 feet into the formation.

5. A method according to claim 1 in which the nitrogen is injected through the first flow path and the oxygen or oxygen enriched air is injected through the second flow path.

6. The method of claim 1 wherein the oxygen concentration of the gas injected during step (g) is increased in stages.

7. The method of claim 1 wherein the in-situ combustion is initiated during step (b) by injecting a mixture of steam and air into the formation.

8. In an in-situ combustion operation for the recovery of oil from a subterranean, oil-containing formation penetrated by at least one injection well and at least one spaced-apart production well comprising the steps of:

(a) completing the injection well with a casing means containing passes through a substantial portion of the vertical thickness of the oil-containing formation to allow fluids to flow from the casing means to the oil-containing formation, and dual concentric tubing strings disposed within said casing means comprising an inner tubing and a larger diameter outer tubing the lower ends of which are in fluid communication with the portion of the casing containing passages, said inner tubing forming a first flow path and the inner tubing cooperating with the outer tubing to form a second flow path;

(b) initiating an in-situ combustion front into the formation by injecting air into the portion of the casing containing the passages through one of the flows paths and from there through the passages into the formation;

(c) continuing injection of said air into the formation until the combustion front has been moved a predetermined distance into the formation;

(d) terminating injection of air and injecting essentially pure oxygen into the portion of the casing containing the passages through one of the flow paths and from there through the passages into the formation;

(e) simultaneously injecting nitrogen at a predetermined injection rate into the portion of the casing containing passages through the other flow path where it combines with the oxygen and then flows into the formation through the passages of said casing means;

(f) continuously measuring the bottomhole temperature of the injection well within the casing means in the vicinity of the oil-containing formation and located below the first flow path;

(g) terminating the injection of oxygen through its respective flow path when the bottomhole temperature rises to an upper specific temperature and simultaneously increasing the flow rate of nitrogen through its respective flow path to a maximum rate; and (h) continuing injection of nitrogen through its respective flow path at a maximum rate until the bottomhole temperature is lowered to a lower specific temperature.

9. The method of claim 7 in which the nitrogen is injected through the first flow path and the oxygen or oxygen-enriched air is injected through the second flow path.

10. The method of claim 7 further including injecting water into the formation through the flowpath through which the oxygen or oxygen-enriched air flowed if the injection of nitrogen during step (h) fails to lower the bottomhole temperature to the desired level.

11. The method of claim 7 further including injecting water into the formation via the second flow path if the injection of nitrogen during step (h) fails to lower the bottomhole temperature to the desired level.

12. The method of claim 7 wherein the injection rate of nitrogen during step (e) is within the range of 1 to 5 percent of the injection rate of oxygen.

13. The method of claim 7 wherein the in-situ combustion is initiated during step (b) by injecting a mixture of steam and air into the formation.

* * * * *

UNITED STATES PATENT AND TRADEMARK OFFICE

CERTIFICATE OF CORRECTION

PATENT NO. :4,566,536

DATED :January 28, 1986

INVENTOR(S) :Billy G. Holmes

It is certified that error appears in the above-identified patent and that said Letters Patent is hereby corrected as shown below:

Column 4, line 24, "very" should be -- vary --.

Column 4, line 47, after "closing" insert -- motor --.

Column 4, line 48, after "flow" insert -- rate --.

Column 6, line 58, "through" should be -- throughout --.

Signed and Sealed this

*Thirtieth* Day of *September 1986*

[SEAL]

*Attest:*

DONALD J. QUIGG

*Attesting Officer*

*Commissioner of Patents and Trademarks*